United States Patent [19]

Iversen

[11] 3,995,443

[45] Dec. 7, 1976

[54] AIR CONDITIONING SYSTEM

[76] Inventor: Rudolf O. Iversen, 151 West Blvd., East Rockaway, N.Y. 11518

[22] Filed: Apr. 24, 1975

[21] Appl. No.: 571,087

Related U.S. Application Data

[63] Continuation of Ser. No. 537,921, Jan. 2, 1975, abandoned.

[52] U.S. Cl. ..... 62/305; 62/310; 165/19; 165/27; 165/34

[51] Int. Cl.[2] ..... F28D 5/00

[58] Field of Search ..... 165/22, 50, 19, 60, 165/34, 103, 27; 62/118, 99, 434, 185, 310, 305; 261/151, 161

[56] References Cited

UNITED STATES PATENTS

| | | | |
|---|---|---|---|
| 1,383,039 | 6/1921 | Uhde | 261/DIG. 11 |
| 2,018,453 | 10/1935 | Lawler | 62/310 |
| 2,048,661 | 7/1936 | Lawler | 62/310 |
| 2,712,927 | 7/1955 | Blum | 165/19 |
| 2,715,515 | 8/1955 | Stair | 165/50 X |
| 2,875,594 | 3/1959 | Schilling | 62/305 |
| 3,259,177 | 7/1966 | Niemann | 165/34 |
| 3,276,516 | 10/1966 | Japhet | 165/27 |
| 3,498,072 | 3/1970 | Stiefel | 62/118 |
| 3,627,032 | 12/1971 | Glad | 62/305 |

*Primary Examiner*—Charles J. Myhre
*Assistant Examiner*—Daniel J. O'Connor
*Attorney, Agent, or Firm*—Morgan, Finnegan, Pine, Foley & Lee

[57] ABSTRACT

A process and apparatus for controlling the air temperature in buildings, particularly large multi-room buildings, which eliminates the use of conventional refrigeration units during substantial portions of the year, providing a significant reduction in energy consumption. A liquid stream is cooled in an air cooling tower outside the building by contact with the ambient or outside air, is filtered to remove contaminants, and is circulated in a cyclical flow directly between the heat exchangers or induction unit coils in the building and the cooling tower outside the building, which preferably cools the liquid substantially to the outside ambient wet bulb air temperature. The system is used when the wet bulb temperature of the outside air is low enough to provide liquid at an effective cooling temperature, preferably at or below the desired temperature of the room air, and more preferably at a predetermined liquid temperature desired at the induction units for cooling. When the liquid at the output of the cooling tower is below the desired liquid cooling temperature, a suitable proportion of return liquid from the building is caused to bypass the cooling tower and is mixed with the cooling tower liquid. Additionally, the cooling liquid is prevented from circulating through the induction unit coils in the rooms in which slight heating is desired and return air from all the rooms is mixed with fresh air and recirculated through a conventional fan back to the rooms in which heat is desired to provide heating of the room air therein without the need to use a conventional heat generation unit. This process can be employed with existing systems having refrigeration and heat generation units.

11 Claims, 3 Drawing Figures

AIR CONDITIONING SYSTEM

This application is a continuation of applicant's copending application Ser. No. 537,921, now abandoned filed Jan. 2, 1975, entitled PROCESS AND SYSTEM FOR CONTROLLING THE AIR TEMPERATURE IN MULTI-ROOM BUILDINGS.

BACKGROUND AND SUMMARY OF THE INVENTION

The present invention relates to air temperature control systems of the central type used in buildings, and more particularly to methods and apparatus which utilize colder outside air to reduce the temperature of the interior air, particularly in large multi-room buildings.

Generally, a conventional air conditioning system installed in a large building employs water circulated through a closed conduit system inside the building having induction unit coils or heat exchangers located along the perimeter of the building or elsewhere to cool recirculated room air to the desired temperature. In such systems, the coolant in the refrigeration unit, which is used to chill the room air perimeter cooling liquid by heat exchange, is in turn cooled by heat exchange with a separate liquid circulated through an entirely separate series of conduits to an air cooling tower usually located on the roof of the building. As is well known in the art, in the conventional air cooling tower spraying means are employed which causes the liquid to be cooled by direct contact with the outside air. As is also well known, since the cooling tower acts as an air scrubber, the liquid picks up all kinds of contaminants and corrosive substances from the pollutants in the air which, if introduced into small conduits such as are found in the induction units inside the building, could cause serious damage due to corrosion, scaling, clogging and the like. Thus, in the conventional air cooling system three separately circulated fluids are generally used: the chill water circulated inside the building in a closed conduit circuit for cooling the room air, the coolant circulated in the refrigeration unit for chilling the cooling liquid, and solely as an adjunct to the refrigeration unit, the cooling tower liquid which is circulated in an open large conduit circuit through an air cooling tower outside the building for cooling the refrigeration unit cooling medium.

With such conventional cooling systems, the refrigeration unit is in substantially continuous year round operation even when the outside air temperature is at or below the desired room temperature. This is required because the interior of the building is effectively insulated from the cold outside air while the perimeter room air is heated by radiation energy from the sun. In addition, the air induction units used to recirculate the room air, and the electric lights, generate substantial quantities of heat which heat up the room air still further. As a result, conventional systems cause substantial consumption of electrical energy and/or steam energy depending on whether the refrigeration unit is electrically or steam driven.

Elimination of the refrigeration unit by utilizing a heat exchanger instead to provide heat interchange directly between the liquid in the cooling tower conduit circuit and the chill water in the interior conduit circuit would not effect significant economies. Apart from the high initial cost of building and installing such a heat exchanger, such a system would have only marginal utility due to inherent capacity limitations and heat losses.

In the conventional practice, during extremely low outside air temperature, for example below about 30°–35° F, the building is placed in a heating mode. The refrigeration unit is shut off and the perimeter or secondary water is circulated through a steam heat generator unit where the water is heated to approximately 100°–140 ° F and circulated through the same induction unit coils providing heat for the rooms. Where limited cooling is required, this is obtained by closing off the induction unit coils to the hot water and introducing outside air into the induction units in those rooms which are warm. However, air which is transmitted over several hundred feet will absorb the heat, raising its temperature as much as 10°–15° F, and therefore will not have much cooling effect. Furthermore, friction heat losses in the fan unit will also produce up to a 5°–15° F rise in temperature of the air. Thus, attempts to use cooler outside air for cooling purposes, particularly during the intermediate seasons, have had but limited success.

It is an object of the present invention to reduce the energy consumption in central air temperature control systems of the type described above.

It is a further object of the invention to provide a central air temperature control system which significantly reduces or eliminates the need for energy-consuming refrigeration units during the cooler periods of the year by effecting cooling via the outside air.

It is still further object to provide such energy conservation with minimal changes to conventional air temperature control systems.

Briefly, the foregoing objects and advantages are accomplished in accordance with the present invention by circulating a single liquid cooling medium having suitable chemical properties between the perimeter or other room air heat exchangers inside the building and an air cooling tower outside the building when it is cold enough outside for the cooling tower to bring the circulating liquid to an effective cooling temperature below the interior air temperature, preferably at or below the desired temperature for the room air, and still more preferably at a predetermined liquid temperature desired for cooling at the room heat exchangers. The water is subjected to spraying in the air cooling tower process where it is brought into direct cooling contact with the outside air and is preferably cooled to substantially the outside wet bulb air temperature. Suitable filtering means, preferably mechanical, are employed to remove contaminants before the liquid is introduced into the interior circuit. In one preferred embodiment, contaminants having a particle size generally greater than about 5 mils to about 10 mils in diameter, which may be picked up in the air cooling tower, are removed. When the temperature of the liquid leaving the cooling tower is below that desired at the induction units, portions of the return cooling liquid are caused to bypass the cooling tower and are mixed with air cooled medium in suitable proportions to provide the desired liquid temperature for cooling.

Advantageously, existing conventional systems can be converted to practice the invention. Preferably, the cooling tower is adapted to cool the liquid introduced thereto substantially to the ambient wet bulb air temperature. Bypass conduits are installed with appropriate valving and filtering means to connect the conduits of the open condenser liquid circuit directly into the interior normally closed liquid circuit so that the refrigeration unit can be bypassed as may be desired during operation. Of course, it will be evident to those of ordinary skill in the art that the circulating liquid must be made compatible for use in the combined system by suitable chemical treatment to prevent corrosion, scaling and the like.

With such arrangement, not only is the refrigeration unit taken out of operation during substantial portions of the year, but the number of pumping units in operation is also reduced because only a single fluid conduit circuit is employed instead of the three separate conventional circuits. When the temperature of certain rooms must be raised slightly, the cooling liquid is prevented form circulating through the induction unit coils in the rooms and air from the rooms is recirculated through the air induction system and is heated by the heat of friction generated by the fan unit. While such use of the recirculating air to heat is not new, its energy saving advantages have in the past been limited. When the building is in the cooling mode during periods when the outside air is below the desired interior air temperature, the wasted energy involved in running the refrigeration machine cancels out any savings resulting from the use of recirculated air to provide limited heating. When in the conventional system the refrigeration machine is shut off to conserve energy and heated water is circulated in the heating mode, the heat energy in the recirculated air becomes superflous and is wasted. Thus, heat energy normally constituting heat loss in conventional systems is advantageously put to use with commensurate further savings in energy due to reduction in operation of steam heat generating units and the like.

One form of prior art air temperature control system and the air temperature control system of the present invention are illustrated in the accompanying drawings, in which.

Figure 1:
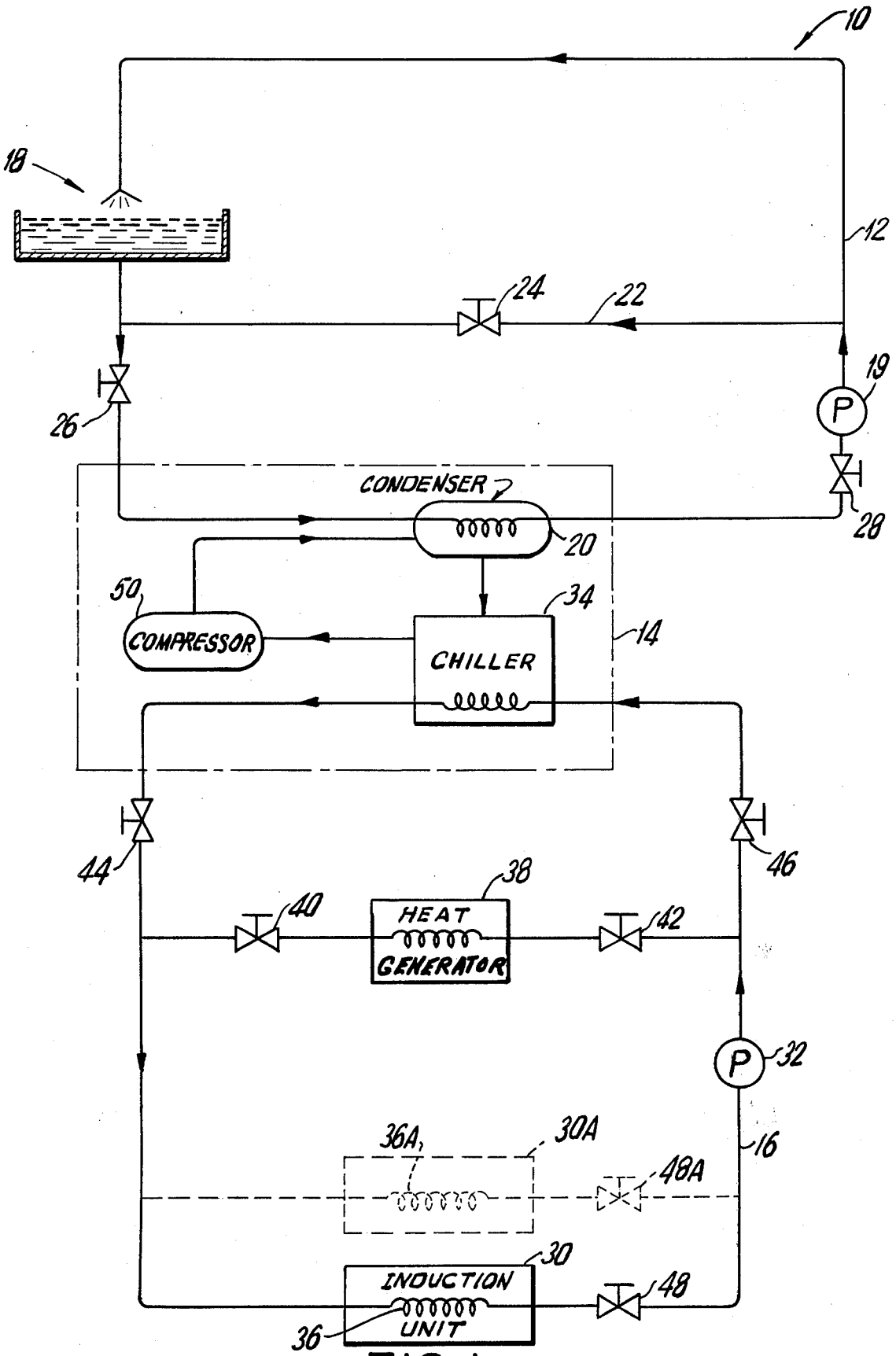
FIG. 1 (PRIOR ART)
FIG. 1 is a schematic of a conventional prior art building air cooling system.

Referring to FIG. 1, a conventional air temperature control system is illustrated generally at 10. The conventional system 10 includes an exterior open condenser liquid path or circuit 12, a refrigeration unit 14, and an interior closed perimeter liquid path or circuit 16.

The open liquid path 12 includes a cooling tower 18 and a pump 19 for circulating a first liquid from the refrigeration unit 14 to the cooling tower 18. The first liquid, which is conventionally water, treated in a manner well known in the art with anti-corrosion additives, e.g., sodium chromate or polyphosphate, dispersents to keep solids in suspension, biocides to control biological growth, and chemical substances to maintain a desired pH, extracts heat from the refrigeration unit 14, specifically from its condensor 20, and is pumped to the cooling tower 18 where it is cooled to approximately 80°–85° F and recirculated by gravity back to the condenser 20. A crossconnecting conduit 22 connects the heated liquid flowing to the cooling tower 18 with the cooled liquid exiting from the cooling tower 18. A temperature sensitive bypass vlave 24 controls the percentage, if any, of mixing of the liquid emerging from the condenser 20 (heated liquid) and the liquid emerging from the cooling tower 18 (cooled liquid), thereby controlling the temperature of the liquid circulated back to the condenser 20 and thus the amount of heat absorbed from the coolant by the liquid as the liquid passes through the condenser 20. Gate valves 26 and 28 enable the condenser liquid circuit 12 to be isolated from the refrigeration unit 14, e.g., for repair to the refrigeration unit 14 or cooling tower 18.

Thus, according to conventional practice, the sole purpose and function of the condenser liquid circuit 12 is to cool the refrigeration unit 14 as just described. Its presence in conventional systems is solely as an adjunct to a refrigeration unit. When the refrigeration unit 14 in conventional systems is not in operation, neither is the condenser liquid circuit 12.

The closed liquid circuit 16 includes a plurality of heat exchangers or induction units 30 and 30A, generally at least one for each room of a building, and a pump 32 for circulating a second liquid from the induction units 30 and 30A through the refrigeration unit 14. The second liquid, which is conventionally water suitably chemically treated with anticorrosion additives and like, e.g., sodium chromate or polyphosphate, to make it compatible for use in the system, takes heat from the room air by heat exchange and adds heat to the refrigeration unit 14, specifically to the chiller 34, and is circulated back to the induction units 30 and 30A all in a closed system. An expansion tank (not shown) is normally included in the conventional system to compensate for liquid expansion and contraction in the closed liquid loop and to provide automatic make-up in the event of leaks or the like.

High pressure air is forced through the induction units 30 and 30A behind their coils 36 and 36A, respectively, creating a vacuum which draws the air present in the room into the induction units 30 and 30A and into contact with the coils 36 and 36A, thereby cooling the air and consequently the room.

A steam heat generator unit 38 or other heating means is provided as part of the conventional system to supply heated liquid, usually when the outside air temperature is below approximately 35° F. To connect the steam heat generator unit 38 into the closed liquid circuit 16, gate valves 40 and 42 are opened and gate valves 44 and 46 closed. The liquid in the closed liquid circuit 16 is heated by the steam heat generator unit 38 and circulated to the induction units 30 and 30A with the aid of the pump 32. Rooms which do not require additional heat have their induction coils 36 and 36A closed off to the heated liquid circuit 16 by means of thermostatically controlled valves 48 or 48A. The rooms containing closed induction unit coils 36 or 36A are cooled, if necessary, by directing cool outside air (high pressure) through the induction units 30 or 30A when the outside air temperature is below about 35° F.

Although other kinds of refrigeration machines, such as absorption machines, are also used in the prior art, for convenience only a compressor-type refrigeration machine is shown in FIG. 1 for purposes of illustration. As will be understood by those skilled in the art, the principles of the present invention are applicable regardless of the kind of refrigeration machine employed.

The refrigeration unit 14 illustrated in FIG. 1 generally includes a condensor 20, a chiller 34, and a compressor 50. A suitable refrigerant or coolant is circulated in the refrigeration unit 14. In the compressor 50 the refrigerant exists as a high pressure, high temperature gas. The high pressure, high temperature gas refrigerant is transmitted from the compressor 50 to the condenser 20 where it is converted to a high pressure liquid and gives up heat to the liquid in the condenser liquid circuit 12. The high pressure liquid refrigerant is transmitted from the condenser 20 to the chiller 34 where it expands to form a low pressure vapor. As is well known, expansion of the liquid refrigerant to vapor form results in the absorption of heat from the second liquid in the closed liquid circuit 16 thereby cooling the same as it circulates through the chiller 34 before being returned to the induction units 30 and 30A.

From the above description, it is apparent that conventional building air temperature control systems involve a substantial waste of energy by obtaining cooling with substantially continuous operation of a refrigeration unit. When the refrigeration unit is not running in order to save energy, and the building is placed in a heating mode, the use of a heat generating unit to provide slight heating also leads to a substantial waste of energy.

In accordance with the present invention, the building can be left in a cooling mode where cooling liquid is circulated in the building without having to run the refrigeration machine during substantial portions of the year. In addition, low load heating requirements can conveniently be satisfied by recirculating the room air without running the heating units thus conserving further energy.

Figure 2:
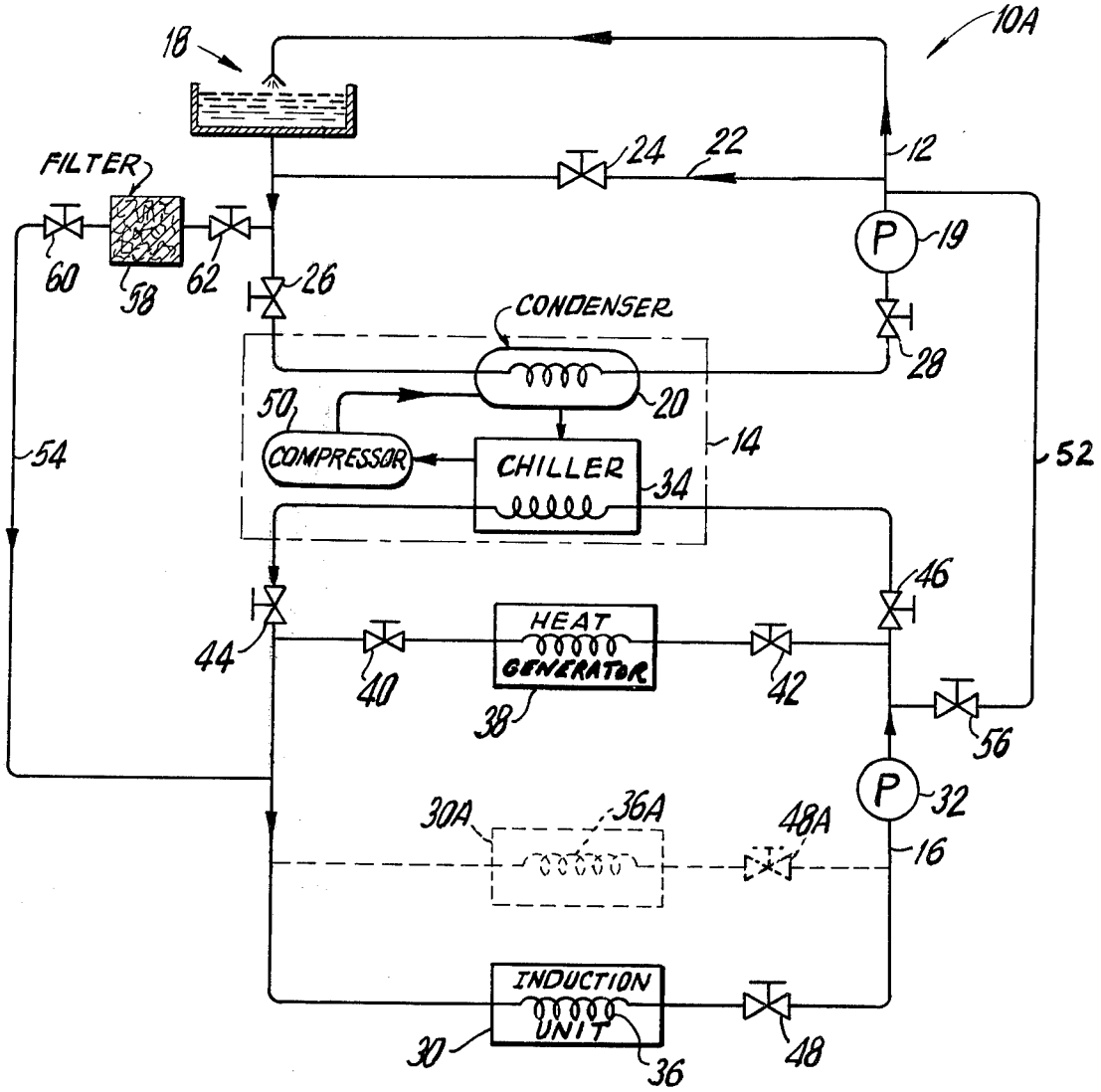
FIG. 2 is a schematic of the air cooling system of the present invention used in combination with the conventional prior art building air cooling system of FIG. 1.

Referring to FIG. 2, in which components identical to those of FIG. 1 are similarly numbered, a system embodying the present invention is schematically illustrated. According to the invention, the air temperature control system 10A includes a pair of conduits 52 and 54 for bypassing the refrigeration unit 14.

Conduit 52 couples the output of the pump 32 of the closed liquid circuit 16 directly to the open liquid circuit 12, and therefore directly to the cooling tower 18. Advantageously, the conduit 52 joins the open liquid circuit 12 at a position above the pump 19, thereby eliminating the need for the pump 19 when liquid is being circulated through the conduit 52. Gate valve 56 enables the conduit 52 to be isolated from the system 10A when not in use. Gate valves 28 and 46 enable the refrigeration unit 14 to be isolated from the system 10A.

Conduit 54 couples the output of the cooling tower 18 and cross-connecting conduit 22 of the open liquid circuit 12 directly to the closed liquid circuit 16, and therefore directly to the induction units 30 and 30A. Preferably, the conduit 54 joins the open liquid circuit 12 at a position above the gate valve 26 and the closed liquid circuit 16 at a position below the gate valve 44, sos that the refrigeration unit 14 can be readily isolated from the system 10A. Gate valve 62 enables the conduit 54 to be isolated from the system 10A when it is not in use.

In accordance with the invention, means is provided for preventing contaminant particles from entering the induction units 30 and 30a. Preferably, mechanical filtering means is employed which enables the system to function continuously, i.e., providing self-cleaning. In the illustrative embodiment of FIG. 2, conduit 54 includes a filter or strainer 58 which removes contaminant foreign particles which enter into the liquid at the cooling tower 18 to prevent the contaminant particles from entering the cooling coils 36 and 36A. Such contaminant particles may foul the cooling coils 36 and 36A as well as other components of the system 10A. In one exemplary embodiment, the filter 58 includes orifices having a diameter of from about 5 mils to about 10 mils for removing foreign particles above this size. As will be readily apparent to those of ordinary skill in the art, the filter should optimumly be selected to remove particles as small as possible without unduly restricting the fluid flow in the system, but larger filters are operative and useful in the practice of the invention. Advantageously, the filter 58 is of the automatic backflushing type which senses an increased pressure differential therein to automatically effect flushing. Gate valves 60 and 62 are included in the conduit 54 on opposite sides of the filter 58 for isolating it from the system 10A to perform any required maintenance operations thereon.

Advantageously, with the system 10A in operation and the refrigeration unit 14 bypassed, there is only one liquid path in the system. Therefore only a single liquid containing a desired anti-corrosion additive, e.g., sodium chromate or polyphosphate, and other suitable chemical additives well known to those skilled in the water treatment art, is required. The corrosion inhibitor and other chemicals prevent corrosion and scale and sludge fouling in the system 10A, maintain a desired pH, and prevent biological growth. Since the open air cooling tower 18 is now part of the interior conduit system, the chemical treatment should be controlled fairly closely to remove or neutralize contaminant and corrosive substances which may be picked up from the air. As will be appreciated, the needed chemical treatment and filtering means may likely vary from building to building depending on the quality of the air and water in the particular locality.

The cooling tower 18 is preferably adjusted to cool the circulating liquid substantially to the ambient or outside wet bulb air temperature. As is self-evident, however, the system of the invention will work in a practical and useful manner even when the cooling liquid is not brought to the outside wet bulb temperature, especially when the temperature of the outside air is significantly below the desired liquid cooling temperature The cooled liquid exiting from the cooling tower 18 and the crossconnecting conduit 22 passes through the filter 58 directly to the induction units 30 and 30A to effect cooling of the air in the respective rooms. The liquid circulating through the coils 36 and 36A picks up sufficient heat generally to raise its temperature between 5° to about 10° F and is circulated back to the cooling tower 18 via conduit 52 where the cycle is repeated.

As previously described, high pressure air is forced through the induction units 30 and 30A, creating a vacuum which draws the air present in the rooms into the induction units 30 and 30a and into contact with the cooling coils 36 and 36A, respectively, containing the cooling liquid, thereby cooling the room air, via a heat exchange.

Thus, if the outside wet bulb temperature is at or below the temperature desired for the interior air, and preferably at or below the desired liquid temperature at the induction units 30 and 30a, which is generally between about 50° to 60° F, the cooling tower 18 will preferably provide sufficient cooling of the circulating liquid so that it may be circulated directly to the induction units 30 and 30A, enabling the refrigeration unit 14 to be bypassed and shut down to conserve energy. If the cooling liquid leaving the cooling tower is below the temperature desired at the induction units 36, the temperature sensitive bypass valve 24 opens automatically to cause suitable proportions of "warm" liquid exiting from the building induction units 30 and 30A to bypass the cooling tower and mix with the "cool" liquid exiting from the cooling tower 18 so that the liquid reaches the induction units 30 and 30A at the desired temperature.

From the foregoing description, it is apparent, that in temperature climates the system 10A in accordance with the invention will enable the refrigeration unit 14 to be bypassed and shut down on almost a continuous basis during the winter months, for substantial portions of the spring and fall months, and even for periods in the summer months in the colder climates, when the wet bulb temperature of the outside air is below about 50° to 60° F. However, as will be understood, the system in accordance with the present invention can be operated to provide useful results whenever the cooling tower is able to bring the cooling liquid to an effective cooling temperature below the existing interior air temperature. Of course, as will be further understood, better results are obtained when the cooling liquid is brought to a temperature at or below the desired interior air temperature, and best results are obtained when the cooling liquid is at the desired liquid cooling temperature for which the system was designed.

During the times when it is determined that the wet bulb temperature of the outside air is above the temperature needed to bring the circulating liquid to an effective or desired cooling temperature, the conduits 52 and 54 are isolated from the system 10A by closing gate valves 56 and 62 and the refrigeration unit 14 is inserted back into the system 10A, by opening gate valves 26, 28, 44, and 46 to obtain cooling in the conventional manner as shown in FIG. 1. An expansion tank (not shown) provides any additional liquid required when resuming operation in the conventional manner.

Figure 3:
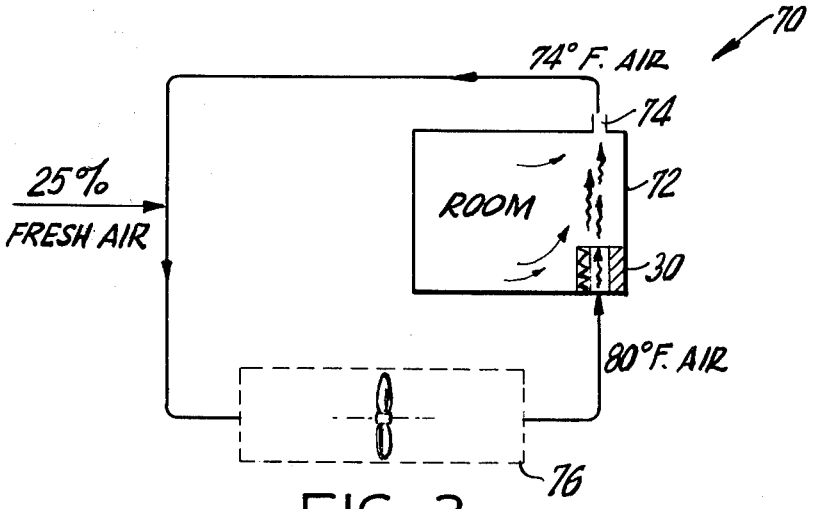
FIG. 3 is a schematic of the air heating system of the present invention for use in combination with the air cooling system of FIG. 2.

Referring to FIG. 3, in accordance with a further aspect of the invention, the air heating system 70 may be employed in combination with the air cooling system 10A of FIG. 2 to provide heat to those rooms 72 which only require a slight rise in temperature thereby eliminating the need to use the steam heat generator unit 38. The thermostatically controlled valves 48 or 48A of those rooms which are too cool are closed to prevent the coolied liquid from circulating the coils 36 or 36A of induction units 30 or 30A. The air in the rooms which has been heated by radiant energy from the sun, by human body heat, and by radiant energy from the lights, is collected via a return air duct 74, combined with 25% fresh air by volume, and circulated by a conventional fan unit 76. The heat generated by friction of the fan raises the temperature of the recirculated air approximately 5° to 10° F. The recirculated air is fed to the induction units 30 and 30A to raise the air temperature of the cool room 72 to the desired level, e.g., 74° F. Thus, by utilizing the air heating system 70, slightly cool rooms, e.g., those on one side of a building which is not receiving the sun, may be heated to their desired temperature level and this temperature level maintained without the need to use the steam heat generaor unit 38, thereby reducing energy consumption.

The system of the present invention may be employed with buildings of the commercial, industrial, and/or residential type. Moreover, the system of the present invention may be utilized to cool rooms including heat generating equipment such as computers. Additionally, the heat generated by the computers may be recirculated in accordance with FIG. 3 to provide heat to cool rooms in the building.

It should be apparent from the foregoing description that the process and system of the present invention attains cooling in buildings with a substantial reduction in cost and energy consumption by eliminating the need for a refrigeration unit and an open circuit water pump preferably whenever the wet bulb temperature of the outside air is at or below the temperature desired in the rooms, and more preferably when it is equal to or below the liquid temperature desired at the induction units. An existing system according to the present invention which is presently in use in an office building in New York City paid for its cost of installation in approximately 9 months due to its savings in energy consumption.

It should also be apparent to those skilled in the art that various modifications may be made in the present invention without departing from the spirit and scope thereof, as described in the specification and defined in the appended claims.

What is claimed is:

1. In an air conditioning process for cooling the interior of a building which includes circulating chill water through induction unit coils or the like in a closed conduit circuit in the interior of said building to remove heat by heat exchange from the air within said building, utilizing a refrigeration machine to continuously remove the heat from said chill water picked up during said heat exchange process to maintain said chill water at the desired cooling temperature, and cooling said refrigeration machine by circulating a second liquid in a separate open conduit circuit having an air cooling tower to cool said liquid, the improvement which comprises:

providing a single aqueous liquid medium and, when the wet bulb temperature of the outside ambient air is low enough to cool said liquid to an effective cooling temperature, circulating said liquid medium directly from the output of said cooling tower to the input of and through said induction unit coils or the like in the interior of the said building, bypassing said refrigeration machine, and circulating at least a portion of said liquid medium from the output of said coils or the like back to the input of said cooling tower, cooling at least said portion of said liquid by subjecting it to direct cooling contact with the outside air in said open cooling tower thereby bringing said liquid medium to an effective cooling temperature, and treating said liquid prior to circulating it to said induction unit coils or the like by removing and neutralizing contaminating and corrosive substances.

2. The improved process of claim 1 further comprising cooling at least said portion of said liquid in said cooling tower substantially to the wet bulb temperature of the outside air.

3. The improved process of claim 1 further comprising cooling said liquid medium substantially to a predetermined liquid temperature desired for heat exchange with the interior air.

4. The improved process of claim 3 further comprising causing a portion of said liquid medium returning from said coils or the like after heat exchange with the interior air to bypass said cooling tower when said portion of liquid medium at the output of said cooling tower is below said predetermined liquid temperature, and mixing said cooled and uncooled portions of liquid to provide a combined liquid at said predetermined liquid temperature.

5. The improved process of claim 4 wherein said predetermined liquid temperature desired for cooling is in the range of about 50° F to about 60° F.

6. In an air conditioning system for cooling a building which includes a closed chill water conduit circuit including heat exchanger means inside the building, a refrigeration machine for cooling said chill water to maintain said water at a desired cooling temperature, and separate cooling tower means outside the building for cooling by exposing a separate liquid medium to direct cooling contact with the outside air and circulating said liquid medium to cool said refrigeration machine, the improvement which comprises:

first conduit means operatively connecting the output of said cooling tower means to the input of said heat exchanger means bypassing said refrigeration machine, second conduit means operatively connecting the output of said heat exchanger means to the input of said cooling tower means bypassing said refrigeration machine, said cooling tower means, heat exchanger means and first and second conduit means establishing a continuous open liquid flow path bypassing said refrigeration machine, valve means for isolating said refrigeration machine from said cooling tower means and said heat exchange means, filtering means located in said first conduit means for preventing contaminant particles from entering said heat exchanger means, and pumping means for circulating a cooling liquid in said continuous open liquid flow path whereby said cooling tower means provides a continuous source of cooling liquid for said heat exchanger means without operation of said refrigeration machine when the outside wet bulb temperature is low enough to provide effecting cooling.

7. The system of claim 6 further comprising tower bypass means including bypass conduit means and mixing valve means for providing a tempering liquid flow path around said cooling tower means, said bypass conduit means directly operatively connecting said first conduit means and said second conduit means by-passing said cooling tower means, said mixing valve means having means for apportioning the liquid flow from the output of said heat exchanger means between said cooling tower means and said bypass conduit means and for mixing the flows in said two paths to provide liquid at an established set temperature.

8. The system of claim 7 wherein said filtering means comprise mechanical strainer means.

9. The system of claim 8 wherein said filtering means includes means for neutralizing corrosive substances in said liquid.

10. The system of claim 6 wherein said cooling tower means is adapted to cool liquid substantially to the wet bulb temerature of the outside air.

11. The system of claim 7 wherein said heat exchanger means in said building is designed to provide optimum cooling at a liquid cooling temperature from about 50° F to about 60° F.

* * * * *